US006571811B2

(12) United States Patent
Kabboush

(10) Patent No.: US 6,571,811 B2
(45) Date of Patent: Jun. 3, 2003

(54) EQUIPMENT RINSING FRAME FOR SELF-CONTAINED UNDERWATER BREATHING APPARATUS

(76) Inventor: Theodore Kabboush, 3657 Miramontes Cir., Wellington, FL (US) 33414

( * ) Notice: Subject to any disclaimer, the term of this patent is extended or adjusted under 35 U.S.C. 154(b) by 89 days.

(21) Appl. No.: 09/800,142

(22) Filed: Mar. 6, 2001

(65) Prior Publication Data

US 2002/0124873 A1 Sep. 12, 2002

(51) Int. Cl.[7] ..... B08B 3/02
(52) U.S. Cl. ..... 134/170; 134/116 R; 134/167 R
(58) Field of Search ..... 134/116 R, 167 R, 134/170

(56) References Cited

U.S. PATENT DOCUMENTS 2,461,149 A * 2/1949 Ericson ..... 223/86
4,729,394 A * 3/1988 Timmes et al. ..... 134/115 R
4,989,624 A * 2/1991 Darling ..... 134/100.1
4,997,000 A * 3/1991 Feast et al. ..... 134/102.3
5,037,487 A * 8/1991 Santos ..... 134/115 R
5,603,341 A * 2/1997 Johnson ..... 134/166 R

* cited by examiner

*Primary Examiner*—Randy Gulakowski
*Assistant Examiner*—Saeed Chaudhry
(74) *Attorney, Agent, or Firm*—Akerman Senterfitt; Michael C. Cesarano

(57) ABSTRACT

A frame for rinsing scuba equipment comprises a lower portion having a base, an external water connection, and a hose connection, lower vertical support members which also carry water to a middle portion having an article rinsing unit, equipment supporting arms, and a BCD rinsing unit, an upper portion being supported by a water carrying vertical support member and including a hanger unit for vertically suspending a body garment, and a water outlet having a nozzle that provides an oscillating spray pattern reaching the interior of the body garment.

14 Claims, 5 Drawing Sheets

EQUIPMENT RINSING FRAME FOR SELF-CONTAINED UNDERWATER BREATHING APPARATUS

BACKGROUND OF THE INVENTION

The importance of maintaining scuba ("self-contained underwater breathing apparatus") equipment dry and free of corrosive elements such as salt water is well known, and is described in some detail in U.S. Pat. No. 4,997,000 to Feast et al., entitled Wetsuit Washing and Drying Assembly and Method. Because such equipment is normally used underwater, commonly at depths from which one could not successfully surface in the event of major equipment failure, divers recognize and appreciate the necessity of cleaning or rinsing their equipment after use, and storing it in a dry environment until the next use. However, the task of rinsing and drying typical scuba equipment before storage can be formidable and time consuming. Such typical equipment may include such items as a wet suit, a skin suit, a hood, a buoyancy control device, fins, boots, gloves, a regulator, a computer and gauges, a mask, a snorkel, weight pockets or a weight belt, and accessories such as a dive light, net, and the like. Accordingly, a number of devices have been developed to assist in the completion of this task. The majority of such devices are intended only to rinse a wet suit. Typical among these are hanger-style devices such as found in U.S. Pat. No. 5,037,487 to Santos, (Spray Hanger for Wet Suit); and U.S. Pat. No. 4,989,624 to Darling, (Wetsuit Washer). These devices support a wet suit on a hanger-like frame, and provide a water spray or jet both internally and externally to the suit, using a hose connection from the hanger to an external water supply. However, these devices are designed solely for the rinsing and drying of wet suits, and do not provide means for the rinsing, drying, storing or transporting of other scuba apparatus. Moreover, other than providing a spray of water from various nozzles located on the support frame, these devices are passive in operation and have no means for oscillating or varying the spray to reach areas of the wet suit not directly subject to a spray or drainage rivulet. As a result, while wetted areas that directly receive a spray, and water drainage areas immediately below wetted areas, subject to the rinsing action of flowing water, other areas not directly subject to the spray, and other non-drainage areas, may experience no rinsing at all. Small wrinkles, nooks, or crannies in the wet suit may escape the rinsing action, and may even capture sand, salt, or debris that is not dissolved or carried away by the action of flowing water.

Other devices, such as that disclosed in U.S. Pat. No. 4,729,394 to Timmes et al., provide a frame for holding other scuba equipment. The frame, however, supports scuba equipment only upon horizontal or nearly horizontal racks, or suspended from "clips" attached to horizontal racks, and does not provide any hanger-like structure from which a wet suit or skin may be vertically suspended. Although the Timmes frame does spray water downwardly from nozzles located at various points on and above the frame, it does not disclose any upward spraying water outlets for spraying inside an inverted, self-draining piece of equipment such as a boot or glove.

What is needed is a frame to hold scuba equipment, including hanger-like structures for vertically suspending a wet suit and skin suit, that completely rinses such equipment externally and, where appropriate, internally, and supports such equipment while drying, and during periods of storage.

SUMMARY OF THE INVENTION

It is an object of this invention to provide a frame having upper hanger-type structures for vertically suspending wet suits and skin suits, a mechanical water diverting sprinkler head for increasing the interior and exterior surfaces of a wet suit or skin suit subject to direct rinsing action, a lower portion having upwardly pointing nozzles for rinsing the interior of gloves and boots, a valve for introducing rinsing water into the air bladder of a buoyancy control device ("BCD"), a manual regulator to adjust for variances in water pressure from an external water source and to provide flexibility in adjusting water pressure between the upper and lower portions of the frame, a plurality of hooks and bars from which other equipment may be suspended, and a hand-held hose for convenience in assuring proper water coverage for all equipment suspended from the frame.

DETAILED DESCRIPTION OF THE DRAWINGS

Figure 1:
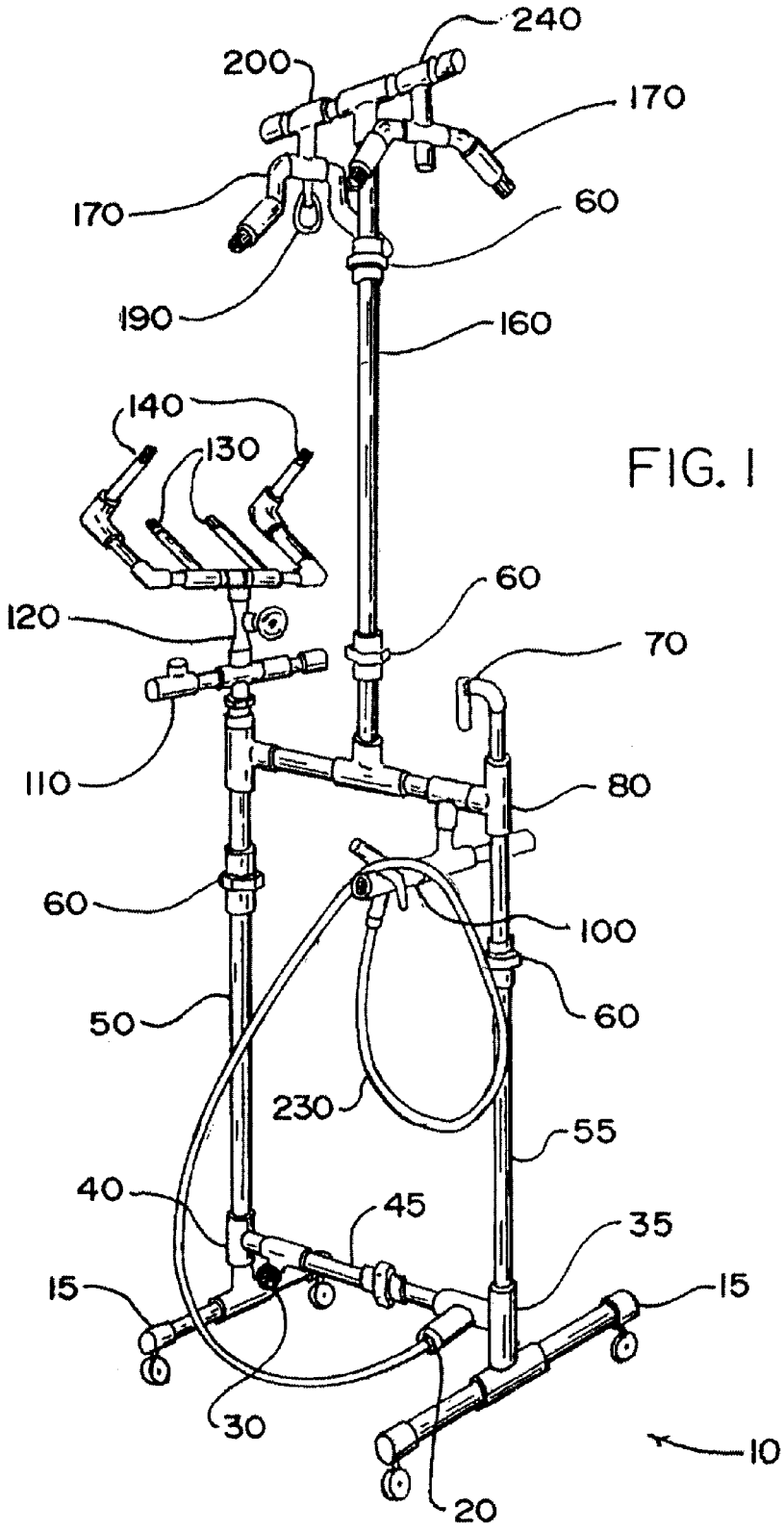
FIG. 1 is a perspective view of the frame of this invention.
Figure 2:
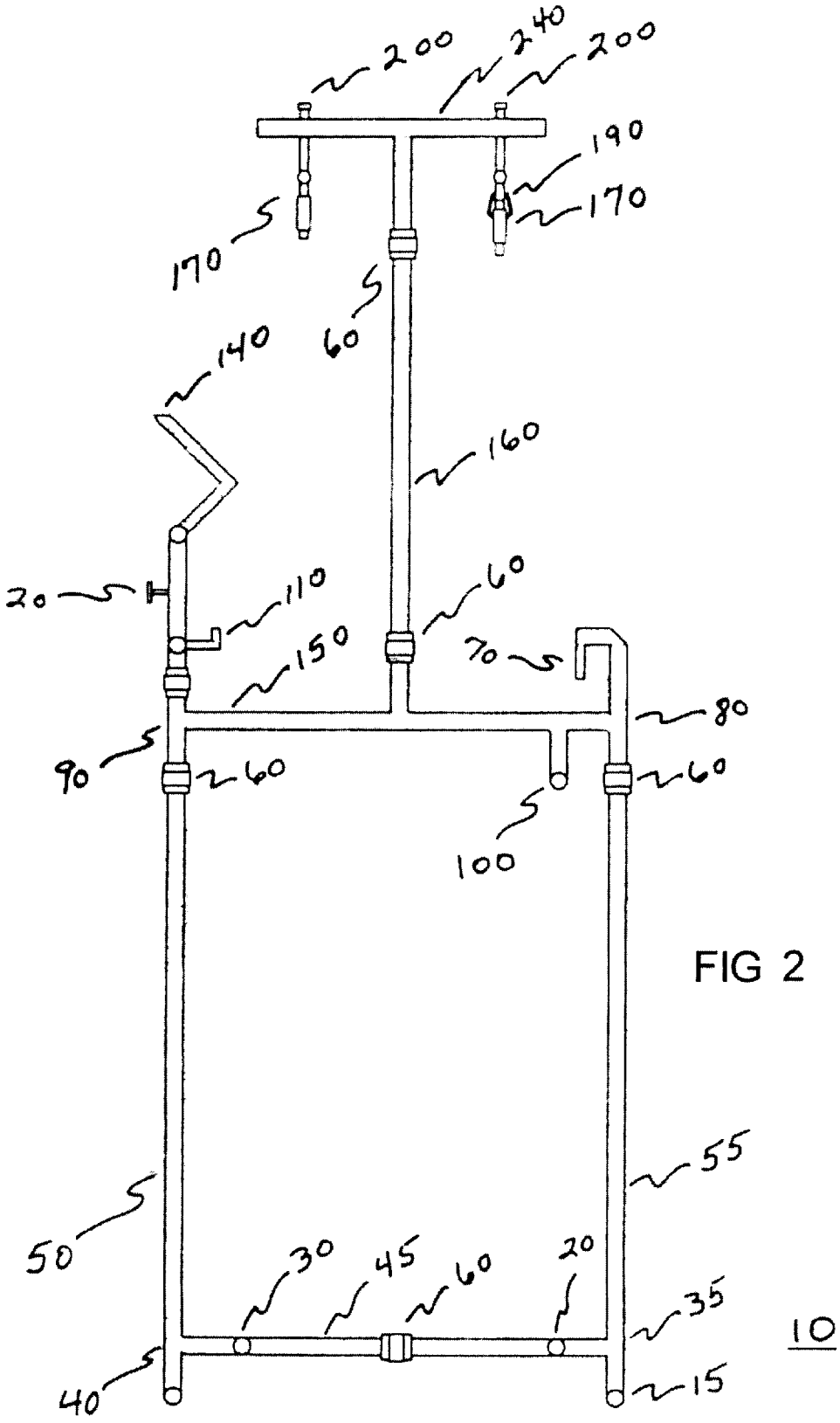
FIG. 2 is a front elevational view of the frame.
Figure 3:
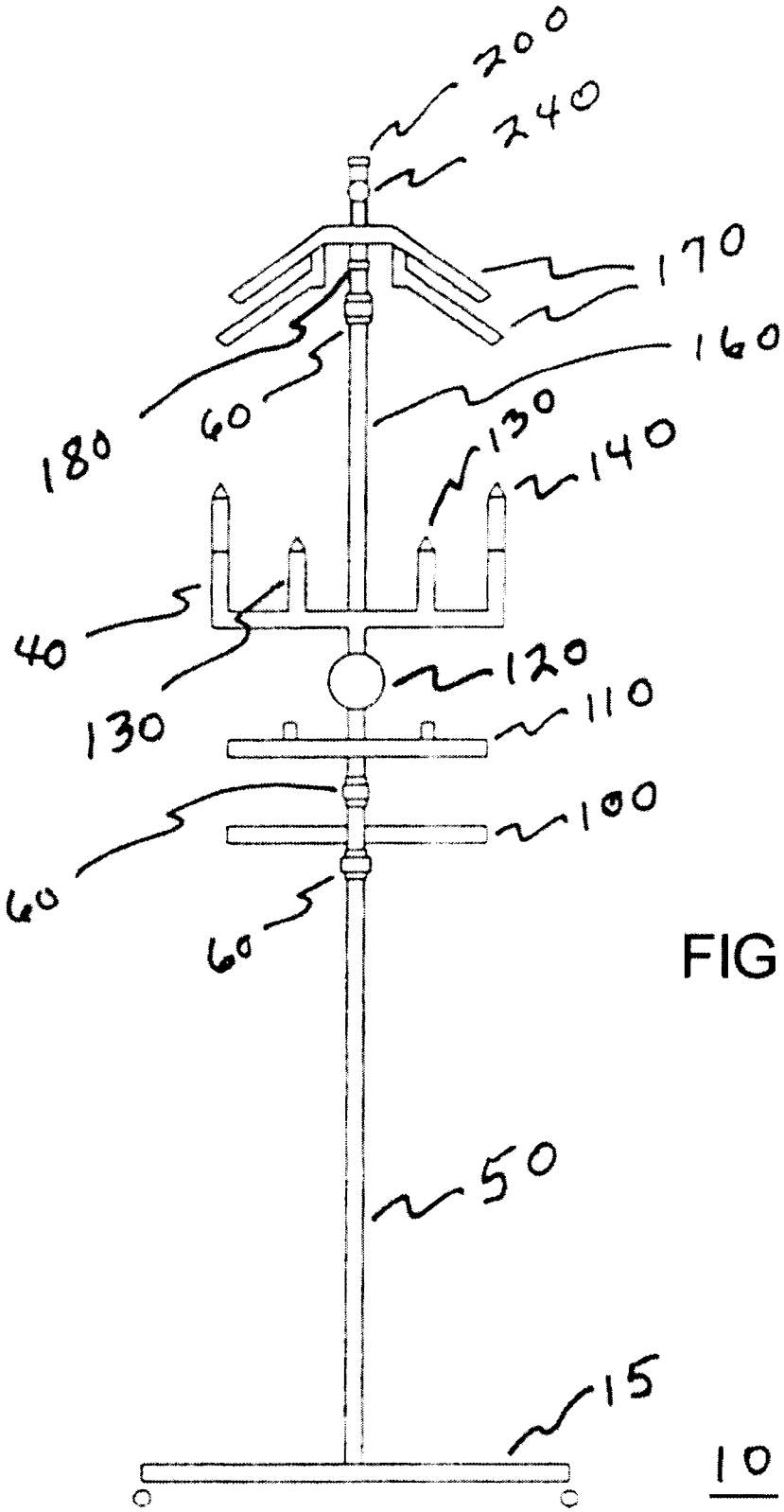
FIG. 3 is a side elevational view of the frame.

FIG. 1 is a perspective view of the frame of this invention. The frame is supported by a base 10 consisting of two crossbars 15 each of which has a wheel or caster at either end. Each crossbar has a vertical support 50, 55 extending upwardly. The vertical supports are connected near the base at "T" sections 35, 40 by a horizontal crossbar 45. Horizontal crossbar 45 has two water connecting points. An external water supply may be connected at connection point 30, and a hose 230 with a manually operated nozzle is connected at 20. Water entering through external connection point 30 travels upward through "T" sections 35 and 40 into vertical supports 50 and 55. Internal seals at the lower ends of "T" sections 35 and 40 prevent water from entering the base 10 and supporting structures 15. These members, although hollow, are sealed internally to prevent water from entering those portions of the structure.

Water traveling upward through vertical supports 50 and 55 reach T-intersections 80 and 90 where it is divided. Part of the water coming up through vertical support 50 continues upward to manually operated valve 120 while the rest is directed along an upper horizontal crossbar 150. Just above valve 120 is a boot-and-glove rinsing unit. When valve 120 is open, water is permitted to travel into the boot-and-glove rinsing unit. Four nozzles 130, 140 are attached to upwardly pointing pipe sections such that the pipes to which nozzles 140 are attached have a right angle bend to direct spray into the toes of boots, while nozzles 130 are directed straight into gloves or other articles having no major bends. A cross member and hook assembly 110 located directly below the boot-and-glove rinsing unit holds other gear, such as a mask, fins, or the like, such that drainage from nozzles 130 and 140 will rinse items supported by the cross member and hook assembly. Because boots and gloves are suspended with their open ends facing downward, they will not collect water when rinsing has been completed and equipment is permitted to dry. When valve 120 is closed, all water coming up through vertical member 50 will be directed into upper horizontal member 150.

At the upper end of vertical support 55 is a "T" section 80 above which a BCD bladder rinsing nozzle 70 is located.

Part of the water coming up through vertical support 55 is directed horizontally into crossbar 150, while the remainder is directed into the BCD bladder rinsing nozzle. A flow restrictor is used to limit the amount of water that will flow to the BCD nozzle, and the nozzle is shaped to introduce rinsing water into the inflator/deflator hose leading to the lower portion of the air bladder of the BCD to flood any debris or salt from the bladder, after which the BCD maybe inverted over the nozzle and allowed to empty and dry. A piece of surgical tubing (not shown) may be used to hold the BCD bladder valve open during rinsing and drying.

On upper horizontal cross member 150, near the "T" section 80 is a second cross member 100 that may be used to support the BCD and other accessories. Although made from hollow PVC tubing, cross members 100 and 110 do not provide a path for water flow, and are not intended to have water in them. They provide only support for various items of scuba equipment.

Figure 4:
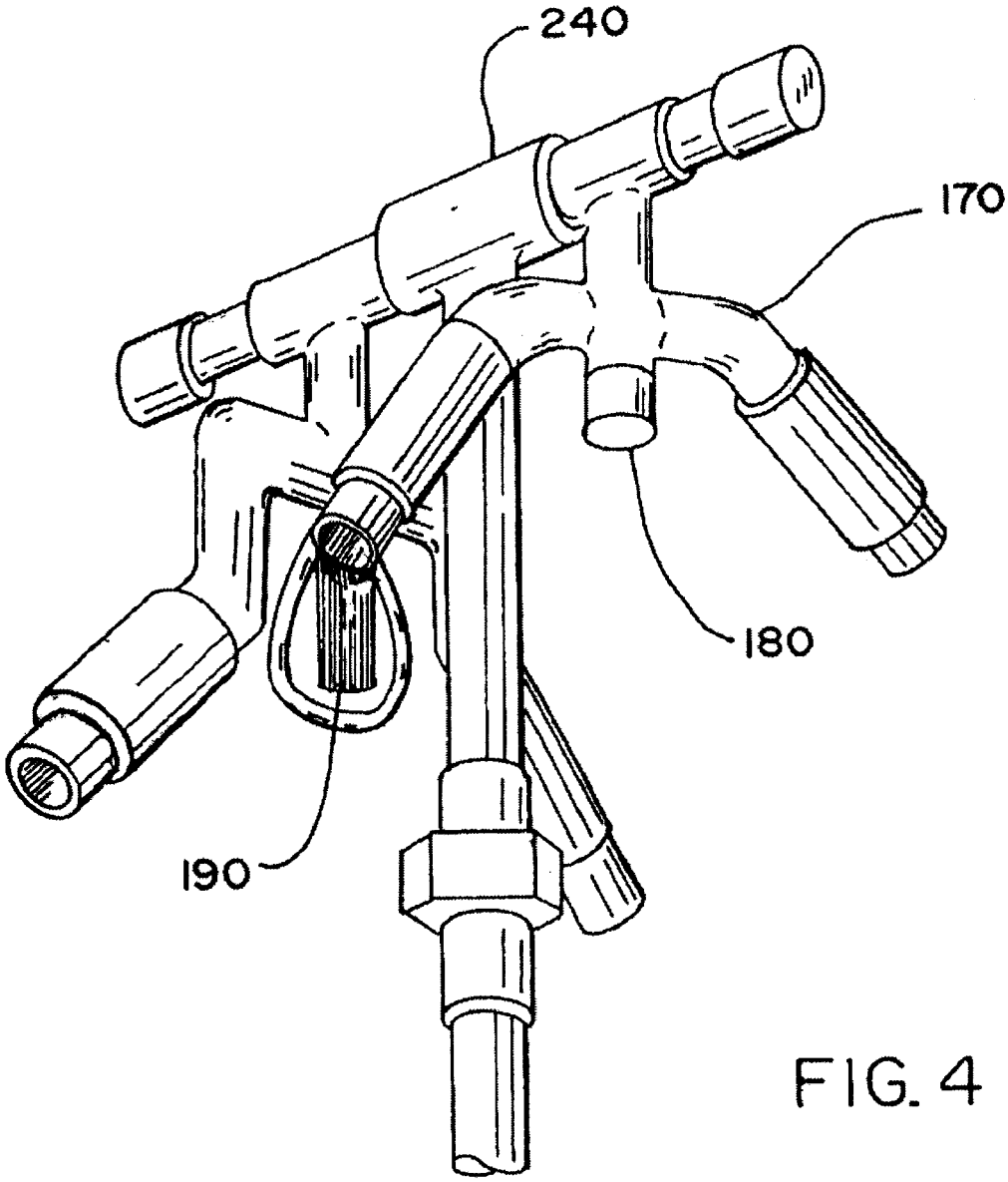
FIG. 4 is a perspective view of the upper portion of the frame.
Figure 5:
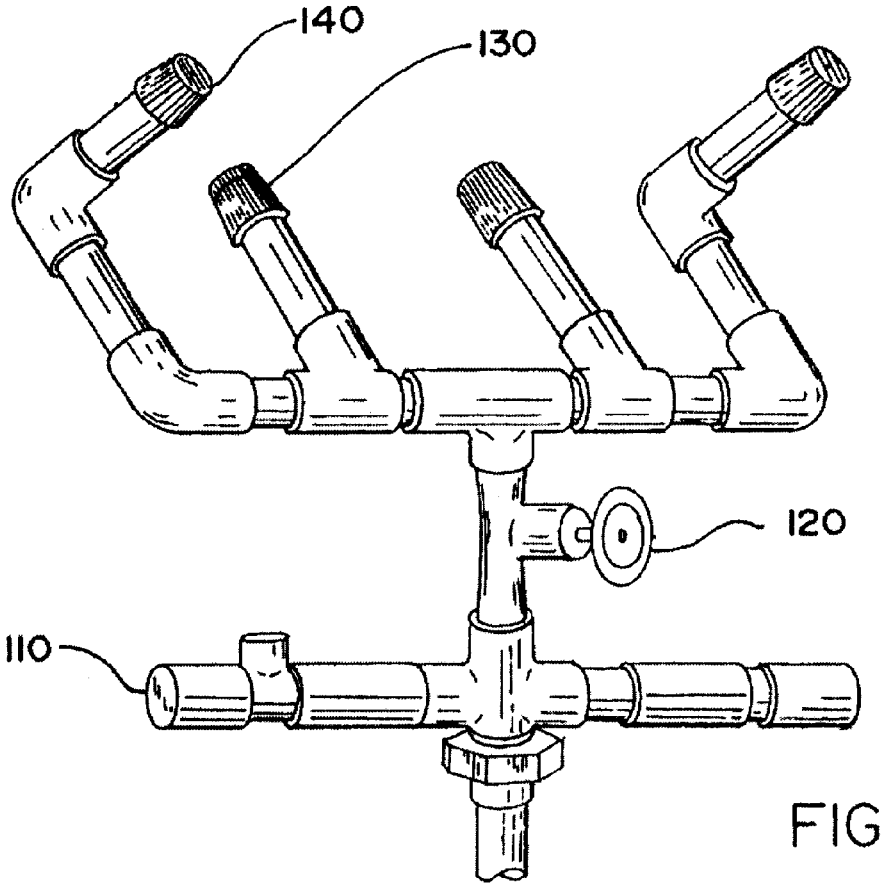
FIG. 5 is a perspective view of the upwardly pointing nozzle portion of the frame.
Figure 6:
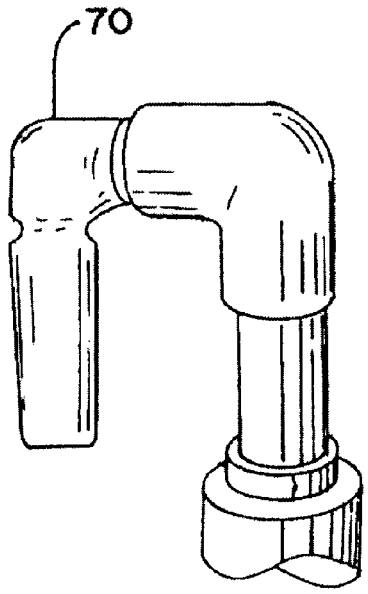
FIG. 6 is a perspective view of the BCD nozzle.

The upper portion of the frame of this invention is a hanger unit having two hangers 170. A wet suit and a "skin" suit (not shown) may be vertically suspended from these hangers, and will be fully extended to hold the arms away from the body of each suit. Water travels upwardly to the hanger unit through vertical support 160, and is divided by a "T" section through cross member 240 to flow to each hanger. Water outlets are located at the center of each hanger structure, immediately above the neck portion of the wet or skin suit supported by the hanger. A rotating "sprinkler" nozzle 190 is used to insure that water spray and splash wet the entire interior of the upper and lower portions of the wet suit. As may be seen in greater detail in FIG. 4, the sprinkler nozzle is located within a small frame that is oriented perpendicularly to the orientation of the wet suit hanger. This small frame serves the dual purpose of holding the wet suit open so that water from the sprinkler may reach all internal areas and cavities of the suit, and of holding the wet suit away from the sprinkler so that it will not physically obstruct the sprinkler from turning. A manually adjustable spray nozzle 180 is located at the center of the skin suit hanger, although a second sprinkler nozzle may be substituted, if desired. The manually adjustable spray nozzle 180 is sufficient to introduce water both externally and internally into the skin suit, which being of substantially lighter weight and greater flexibility than the wet suit, needs less water action than the wet suit to be thoroughly rinsed. The amount of water received by the hanger unit may be adjusted both by changing the external water pressure entering the device, and by adjusting manual valve 120.

If additional water is desired for rinsing the outer surface of the wet suit and skin suit, additional nozzles 200 may be provided above each hanger. Water exiting through such upper nozzles will rinse the exterior surfaces of garments hanging below the nozzles.

A hose 230 is provided for manual use to spray and rinse external surfaces of scuba equipment on or near the rack, such as air tanks or other items located nearby. A hand-actuated nozzle allows the hose spray to be modulated and directed to those piece of equipment for which additional spray is desired.

Once scuba equipment has been thoroughly rinsed and dried, it may remain on the frame for storage until its next use. Because the equipment is hanging open on the frame, drying time will be short, and the incidence of mold and mildew will be reduced or eliminated. The frame and equipment may be wheeled into a storage closet or other storage area, and the equipment will be retained in a clean and dry state until removed.

The frame may be constructed of any material, and prototypes made from hollow PVC pipe have proved to be ideal in water carrying and corrosion-resistant properties. The frame is completely collapsible and portable, and may be disassembled for transport by disconnecting frame sections at disconnect points 60, or at other disconnection points that maybe dictated by structural and design requirements. Each disconnect point has a watertight gasket and threaded nut and bolt assembly designed for easy assembly and disassembly without the need for tools.

If multiple hangers are desired to hold wet suits and equipment for more than one diver, a second set of hangers and other spray nozzles can be added to the unit. Alternative embodiments may include attaching a second hanger unit, boot-and-glove unit, and BCD bladder rinsing unit, or any combination thereof, to a single frame, or locating such units at different places on the frame. While it is understood that each of the elements described above, or two or more together may also find a useful application in other types or methods differing from the type described above, the invention is not intended to be limited to the details given above since it will be understood that various omissions, modifications, substitutions and changes in the forms and details of the device illustrated, and in its operation, can be made by those skilled in the art without departing in any way from the spirit of the present invention.

What is claimed is:

1. A frame for rinsing scuba equipment comprising:

a lower portion, said lower portion having a base, an external water connection, and a hose connection, and being attached to one or more lower vertical support members at least one of which also serves as a conduit for transporting water entering through said external water connection upwardly to portions of said frame located above said lower portion;

a middle portion, said middle portion being supported by said one or more lower vertical support members and comprising an article rinsing unit, a plurality of support members, and a buoyancy control device rinsing unit, said article rinsing unit further comprising a plurality of upwardly directed water nozzles located at the ends of article supporting water conduits, said article supporting water conduits being situated to support articles of scuba equipment, said upwardly directed water nozzles being positioned to direct water at articles supported by said article supporting water conduits, water being provided to said article rinsing unit through at least one of said one or more lower vertical support members, said buoyancy control device rinsing unit comprising a buoyancy control device nozzle adapted to introduce water into an air bladder of a buoyancy control device, said middle portion being attached to the lower end of one or more upper vertical support members and forming a conduit to carry water from at least one of said lower support members into at least one of said one or more upper vertical support members, said middle portion further comprising at least one adjustment valve for adjusting water flow within said middle portion;

an upper portion, said upper portion being supported by one or more upper vertical support members and comprising a hanger unit, said hanger unit further comprising one or more hanger structures for vertically suspending a body garment, said one or more hanger structures further comprising oppositely extending supports and at least one water outlet, at least one said water outlet having a nozzle that provides an oscillating spray pattern, said spray pattern reaching at least an interior portion of a suspended body garment.

2. A frame for rinsing scuba equipment as claimed in claim 1, further comprising a wheeled base.

3. A frame for rinsing scuba equipment as claimed in claim 1, further comprising a hose attached to said hose connection, said hose further comprising a hand-actuated nozzle for directing and modifying water flowing through said hose.

4. A frame for rinsing scuba equipment as claimed in claim 1, in which at least one of said article supporting water conduits includes an angular bend such that water exiting from said nozzle on said article supporting water conduit is directed at an interior portion of an article of scuba equipment suspended upon said article supporting water conduit.

5. A frame for rinsing scuba equipment as claimed in claim 1, in which said hanger unit further includes at least a second said hanger structure, said second hanger structure having a nozzle for directing a water spray at both an interior and an exterior surface of a body garment suspended upon said second hanger structure.

6. A frame for rinsing scuba equipment as claimed in claim 1, further comprising a plurality of assembly joints for assembling and disassembling said frame for storage or carriage.

7. A frame for rinsing scuba equipment as claimed in claim 1, in which said adjustment valve in said middle portion is located between said article rinsing unit and said one or more lower vertical support members that provide water to said middle portion.

8. A frame for rinsing scuba equipment comprising:

means for suspending boots and gloves in an inverted position such that water introduced into suspended boots and gloves will drain downwardly;

means for suspending body apparel vertically and laterally such that a substantial portion of the interior and exterior surfaces of suspended body apparel are exposed to the air, and water introduced into suspended body apparel will drain downwardly;

means for supporting a buoyancy control device with the air valve for the air bladder of said buoyancy control device being held open;

means for suspending other items of scuba equipment from said frame;

means for introducing a water spray into the interior portions of said boots and gloves;

means for introducing an oscillating spray upon an interior surface of suspended body apparel near the upper portion of suspended body apparel.

9. A frame for rinsing scuba equipment comprising a lower portion having a base, an external water connection, and a hose connection, said lower portion comprising a water conduit that is attached to one or more lower vertical support members which carry water to a middle portion comprising a glove and boot rinsing unit, equipment supporting arms, and a buoyancy control device rinsing unit, said middle portion comprising a water conduit that is attached to a water carrying vertical support member, an upper portion supported by said water carrying vertical support member and comprising at least one hanger unit for vertically suspending a body garment, and at least one water outlet having a nozzle that provides an oscillating spray pattern to rinse the interior of a suspended body garment.

10. A frame for rinsing scuba equipment comprising:

a lower portion having an external water connection, a middle portion having an article rinsing unit comprising a plurality of upwardly-directed nozzles, an upper portion having a hanger unit and a movable nozzle, a flexible hose connected to said frame, said lower portion further comprising a water conduit and being connected to said middle portion by one or more lower vertical support members, at least one of said one or more lower vertical support members being connected to said middle portion and further comprising a water conduit that carries water to said middle portion, said middle portion being connected to one or more upper vertical support members, at least one of said one or more upper vertical support members further comprising a water conduit that is attached to said upper portion, said upper portion further comprising a Water conduit disposed to carry water to said movable nozzle, said nozzle being imparted with rotational movement by the movement of water passing through said upper portion.

11. A frame for rinsing scuba equipment as claimed in claim 10, said nozzle provides oscillating rotational movement.

12. A frame for rinsing scuba equipment as claimed in claim 10, said article rinsing unit further comprising supporting members disposed to support items of equipment in an inverted position.

13. A frame for rinsing scuba equipment as claimed in claim 10, said middle portion further comprising a buoyancy control device rinsing unit.

14. A frame for rinsing scuba equipment as claimed in claim 10, said frame further comprising a valve being adjustable between at least a first and second position, said valve directs at least a portion of the water to said article rinsing unit when said valve is in said first position, said valve directs at least a portion of the water to said upper portion when said valve is in said second position.

* * * * *